US006332761B1

(12) United States Patent
Guentert et al.

(10) Patent No.: US 6,332,761 B1
(45) Date of Patent: Dec. 25, 2001

(54) RADIAL PISTON PUMP FOR HIGH PRESSURE FUEL DELIVERY

(75) Inventors: Josef Guentert, Gerlingen; Hansjoerg Frey, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,224

(22) PCT Filed: Sep. 4, 1998

(86) PCT No.: PCT/DE98/02611

§ 371 Date: Jun. 5, 2000

§ 102(e) Date: Jun. 5, 2000

(87) PCT Pub. No.: WO99/19621

PCT Pub. Date: Apr. 22, 1999

(30) Foreign Application Priority Data

Oct. 9, 1997 (DE) ..... 197 44 577

(51) Int. Cl.[7] ..... F04B 7/04
(52) U.S. Cl. ..... 417/490; 137/539.5
(58) Field of Search ..... 417/470, 454, 417/571, 364; 137/539.5, 540.11

(56) References Cited

U.S. PATENT DOCUMENTS 4,277,229 * 7/1981 Pacht ..... 417/454
5,382,140 * 1/1995 Eisenbacher et al. ..... 417/273
6,238,189 * 5/2001 Guentert ..... 417/273

* cited by examiner

*Primary Examiner*—Charles G. Freay
*Assistant Examiner*—William H. Rodriguez
(74) *Attorney, Agent, or Firm*—Ronald E. Greigg

(57) ABSTRACT

The invention relates to a radial piston pump for high-pressure fuel delivery in fuel injection systems of internal combustion engines in a common rail injection system having a drive shaft that is supported in a pump housing. The drive shaft is eccentrically embodied or has a number of cam-like projections in the circumference direction, and a number of pistons are arranged radially in relation to the drive shaft. Each piston reciprocates a respective cylinder chamber and is moved in a reciprocating fashion in the cylinder chamber when the drive shaft rotates. A spring-preloaded check valve is assembled on the intake side and on the high pressure side, and a component that includes a through opening constitutes the respective cylinder chamber. A high-pressure delivery opening leads away from the cylinder chamber and in the sealing seat of the high pressure side check valve, opens out into a mounting opening of the component. The mounting opening contains the valve components. In order to achieve a simplified assembly in a vicinity of the high pressure side check valve, with the exception of a valve body which is placed against the sealing seat, the high pressure side check valve is inserted into the mounting opening as a preassembled unit and is tightened against the component to form a high-pressure seal.

20 Claims, 2 Drawing Sheets

RADIAL PISTON PUMP FOR HIGH PRESSURE FUEL DELIVERY

PRIOR ART

The invention relates to a radial piston pump for high pressure fuel delivery in fuel injection systems of internal combustion engines, in particular in a common rail injection system, having a drive shaft that is supported in a pump housing and is eccentrically embodied or has cam-like projections in the circumference direction. The piston pump and preferably has a number of pistons which are arranged radially in relation to the drive shaft, each in a respective cylinder chamber, and can be moved in a reciprocating fashion in the cylinder chamber when the drive shaft rotates. The piston pump has a spring-preloaded check valve respectively on the intake side and on the high pressure side, and has a component with a through opening that constitutes the respective cylinder chamber. A high-pressure delivery opening leads away from the cylinder chamber and in the sealing seat of the high pressure side check valve, opens out into a mounting opening of this component which opening contains the valve components.

OBJECTS AND ADVANTAGES OF THE INVENTION

A radial piston pump of this kind has been disclosed by Mannesmann-Rexroth GmbH. The assembly of the high-pressure side check valve is complicated since this valve includes a number of components which have to be inserted into the mounting opening of the component that constitutes the respective cylinder chamber. The check valve is not accessible since the valve components are covered by a flange plate which holds the valve components in the mounting opening. The high-pressure seal is produced by using elastomer seals.

Based on this, the object of the current invention is to improve a radial piston pump of the type mentioned above so that in the vicinity of the high-pressure side check valve, a simplified assembly and more reasonably priced manufacture are achieved.

This object is attained according to the invention with a radial piston pump of this generic type by virtue of the fact that with the exception of a valve body which can be placed against the sealing seat, the high-pressure side check valve can be inserted into the mounting opening as a preassembled unit and can be tightened against the component to form a high-pressure seal.

In order to assemble the high-pressure side check valve, therefore, the preferably ball-shaped valve body is first inserted into the mounting opening. Through a preferably conical embodiment of the mounting opening in the vicinity of the sealing seat, the valve body can be assured of assuming its proper position during assembly. Then the preassembled valve unit is inserted and tightened against the component. For this purpose, the preassembled valve unit preferably has a sealing element of with an external thread which can be screwed into an internal thread of the mounting opening.

The high-pressure seal is preferably produced by virtue of the fact that the sealing element rests with an axial shoulder or end face against an axial step of the mounting opening.

In a very particularly advantageous embodiment of the invention, the sealing surface pair of the sealing element and the axial step in the mounting opening has a flat sealing surface on the one part and a preferably sharp-edged, closed circumferential projection on the other part, which when the components are tightened against each other, produce a high pressure seal. In this connection, when the components are tightened against each other, a sealing plastic deformation takes place along the contact line of the flat and the sharp-edged sealing surfaces. Therefore no elastomer sealing elements, which are susceptible to aging, have to be used, which also almost always prevent a definite, mutually decoupled contact of the components against each other. A high pressure seal can be achieved by virtue of the fact that the valve unit, which can be preassembled, is tightened against the metallic component which constitutes the mounting opening and also the cylinder chamber(s).

In a preferred embodiment of the high-pressure side check valve, the valve unit includes a cup-shaped loading element, which is pre-stressed in the closing direction and can move in a limited fashion in the closing or opening direction, and which, with the outside of its cup bottom forming a spring plate, forces the valve body into contact with the sealing seat. If the valve body is embodied as ball-shaped in a preferred manner, then the outside of the cup bottom of the loading element preferably has an arc shape that corresponds to the ball shape.

The cup-shaped loading element in this connection is dimensioned, pre-stressed, and embodied in its axial mobility in such a way that during the assembly of the valve unit, the valve unit can be placed with the outside of its cup bottom against the valve body and then can be moved back slightly in the direction toward the sealing element until this element has reached its sealing end position.

The preassembled valve unit preferably includes a pin-shaped projection, which engages in the cup-shaped loading element from the side remote from the cup bottom of and guides the loading element radially in its axial movement in the closing or opening direction. The cup-shaped loading element could, for example, be pre-stressed in the closing direction, i.e. in the direction toward the sealing seat of the mounting opening, by means of a spiral spring provided around the pin-shaped projection. The spiral spring in this connection could, for example, be supported against the sealing element. Meanwhile, it has turned out to be advantageous if a spring is provided on the interior of the cup-shaped loading element and is supported on one end against the inside of the cup bottom and is supported on the other end against an end face of the pin-shaped projection. This results in a compact design of the preassembled valve unit.

In order to prevent the cup-shaped loading element from becoming detached from the valve unit due to the initial stress of the spring, the cup-shaped loading element is locked by means of an axial stopping means. According to a preferred embodiment of the preassembled valve unit, the pin-shaped projection has a diametrically reduced axial section which is preferably embodied by an annular recess and the cup-shaped loading element engages with a projection in this axial section. Contact of the projection against an axial step of the projection, which defines the diametrically reduced axial section, prevents the cup-shaped loading element from becoming detached from the pin-shaped projection.

According to a preferred improvement of the concept of the invention, the projection is constituted by a crimping of the edge of the cup-shaped loading element oriented toward the sealing element. The crimping can be embodied as continuous in the circumference direction. However, it turns out to be advantageous if only one or a number of partial sections in the circumference direction of the edge are crimped so that an uncrimped edge section of the cup-shaped loading element can be placed against an axial stop face in order to embody a stroke limitation. The axial stop face can preferably be embodied by an end face of the sealing element.

Other features, details, and advantages of the invention ensue from the graphic depiction and the following description of a preferred embodiment of the radial piston pump according to the invention.

DETAILED DESCRIPTION

Figure 1:
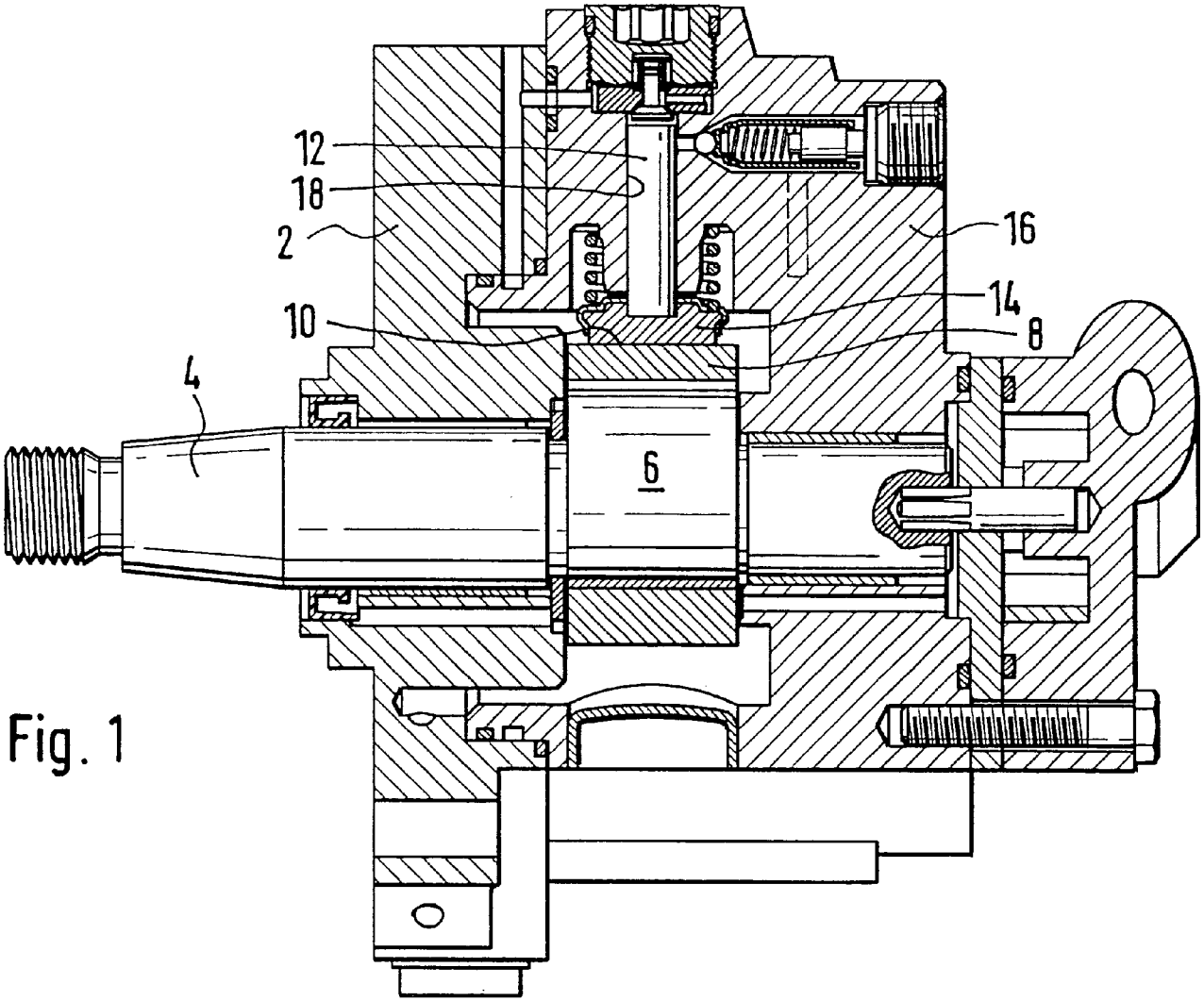
FIG. 1 is a longitudinal sectional view of a radial piston pump according to the invention.
Figure 2:
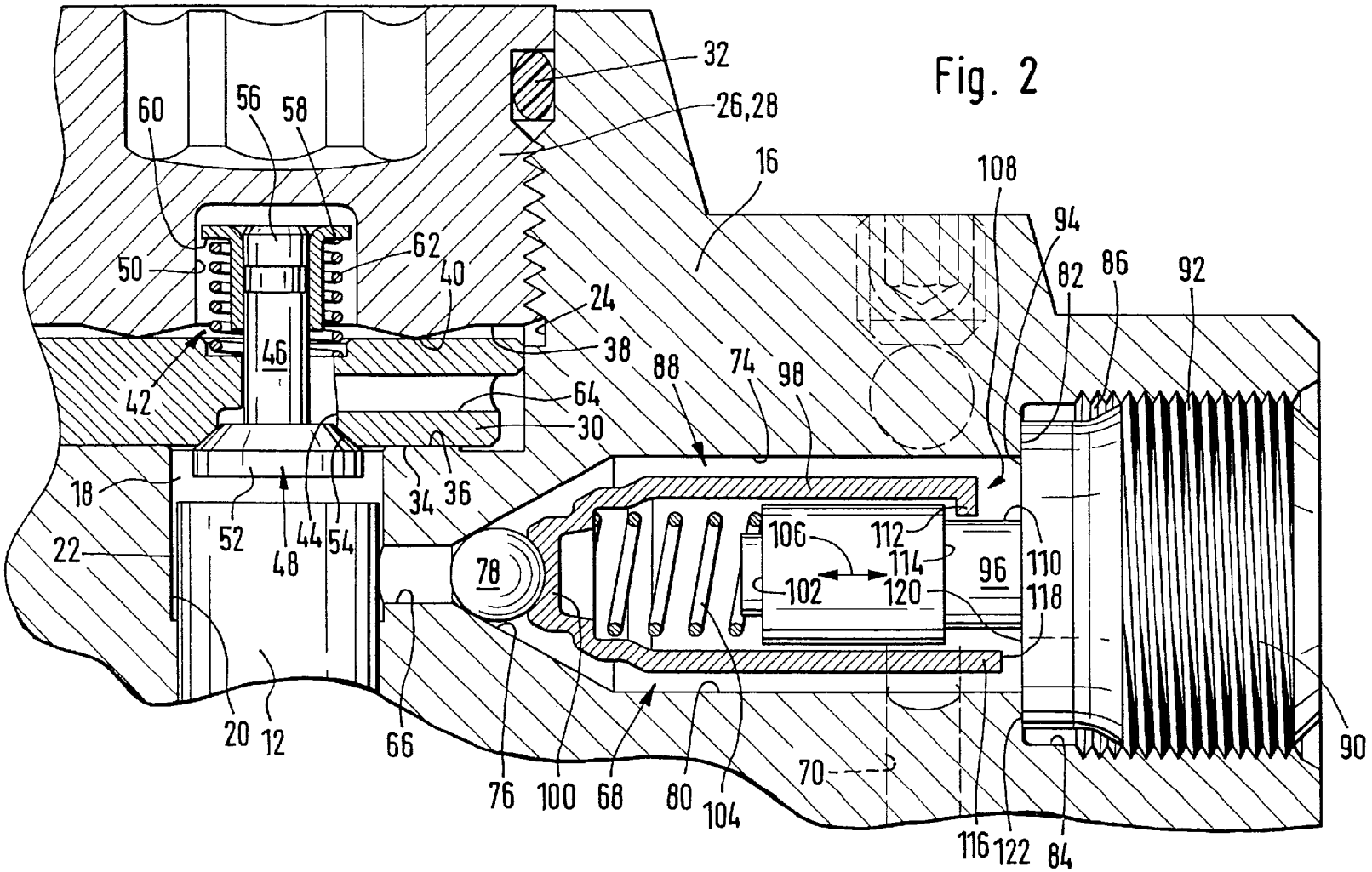
FIG. 2 is a partial view from FIG. 1, in an enlarged depiction.

FIGS. 1 and 2 depict a radial piston pump for high-pressure fuel delivery in fuel injection systems of internal combustion engines. The radial piston pump includes a drive shaft 4 supported in a pump housing 2, with an eccentrically embodied shaft section 6. An intermediary bushing 8 is provided on the eccentrically embodied shaft section 6 and the shaft section 6 can rotate in relation to this bushing. The intermediary bushing 8 includes three flattenings 10 that are offset from one another by 120°, against each of which a piston 12 rests with a block-like contact section 14. The pistons 12 are each contained in a respective cylinder chamber 18 embodied by a solid metallic component 16 so that the pistons can move in the radial direction in relation to the drive shaft 4. A through opening 20 is provided in the component 16 in order to constitute the cylinder chamber 18. The through opening 20 is embodied as stepped and has a smaller diameter section 22 that constitutes the actual cylinder chamber 18 and a larger diameter section 24. A sealing element 26 is inserted in a pressure tight fashion into the radially outer end of the through opening 20, i.e. into the larger diameter section 24. The sealing element 26 is a screw plug 28 which, with the interposition of a plate 30 that will be described in more detail below and an O-ring seal 32, is screwed into the larger diameter section 24 of the through opening 20. The plate 30 rests with a flat contacting surface 34 against a flat, annular collar-like surface 36. On its end face 38 oriented toward the plate 30, the screw plug 28 has a sharp-edged, closed, circumferential bead-shaped projection 40, a so-called biting edge, which rests against the flat top of the plate 30. If the screw plug 28 is screwed into the thread of the larger diameter section 24, then a high pressure seal is produced by means of a slight plastic deformation along the contact line of the bead-shaped projection 40 and the plate 30, as well as in the vicinity of the surfaces 34, 36 resting against each other.

Together with the plate 30, the sealing element 26 contains an intake side check valve 42. The valve plate 30 includes a central opening 44 in which a tappet 46 of a valve body 48 of the intake side check valve 42 reaches through. The tappet 46 engages in a recess 50 in the screw plug 28 and on its opposite end oriented toward the piston, has a valve disk 52 which can be placed in a sealed fashion against a sealing seat 54 that is constituted by the plate 30.

A collar bushing element 58 is placed on the tappet section 56 that engages in the recess 50. A spring 62 is supported between the collar 60 of the collar bushing element 58 and the plate 30 and stresses the tappet 46 in the direction of the recess 50 in the screw plug 28. The fuel delivery to the cylinder chamber 18 takes place through a radial opening 64 in the plate 30 which feeds into the tappet opening 44. When the piston 12 is moved downward, then as a result of the vacuum produced, the tappet 46 and therefore the valve disk 52, is lowered from the valve seat 54 and fuel is aspirated into the cylinder chamber 18 by way of the opening 64. During the next compression stroke of the piston 12, the intake side check valve 42 closes and high-pressure fuel is supplied by way of a radial bore 66 and a high pressure side check valve, which is indicated as a whole by the reference numeral 68, by way of a high-pressure supply line 70 and a high-pressure connection, not shown, of the internal combustion engine.

The high-pressure side check valve 68 is embodied as follows:

In the metallic component 60, which also defines the cylinder chamber 18, a mounting opening 74 is provided radial to the longitudinal direction of the cylinder chamber 18. The above-mentioned bore 66 feeds into the mounting opening 74, which extends in a cone shape in the vicinity of the mouth and constitutes a valve seat 76 there for a ball-shaped valve body 78 of the check valve 68. The conical section widens out into a cylindrical section 80 with a first diameter, which transitions by way of an axial step 82 into an enlarged end section 84 with an internal thread 86.

A preassembled valve unit 88 can be inserted into this mounting opening 74. The valve unit 88 includes a sealing element 90 in the form of a screw plug, which can be screwed with an external thread 92 into the internal thread 86. A pin-shaped projection 96 protrudes from the inwardly directed end face 94 of the sealing element 90. The pin-shaped projection 96 engages in a cup-shaped loading element 98. A compression spring 104 is supported between a cup bottom 100 and an end face 102 of the pin-shaped projection 96 and prestresses the cup-shaped loading element 98 in the direction toward the valve body 78. The loading element 98 can therefore be moved in a floating support by means of the pin-shaped projection 96 in the adjusting direction 106 of the valve and is therefore guided in the radial direction by the pin-shaped projection. Manufacturing tolerances can be compensated for by means of the play of this floating support.

In the vicinity of the circumferential edge 108 of the loading element 98, the pin-shaped projection 96 has a diametrically reduced axial section 110 in the form of an annular recess. The cup-shaped loading element 98 engages in this annular recess with a crimped edge section 112. This prevents the cup-shaped loading element 98 from becoming detached from the pin-shaped projection 96 due to the initial stress of the spring 104. When the valve unit 88 is not yet installed, the crimped edge section 112 rests against a flank 114 of the diametrically reduced axial section 110. Another uncrimped edge section 116 of the cup-shaped loading element 98 can be placed with its axial end face 118 against an axial stop region 120 of the sealing element 90.

In a manner that corresponds to the sealing element 26, on its end face 94, the sealing element 90 has a circumferential, sharp-edged, bead-shaped projection 122, which is tightened against the axial step 82 of the mounting opening 74 to form a biting edge, which produces a high pressure seal.

During the compression stroke of the piston 12, the valve body 78 is lifted up from its sealing seat 76 counter to the force of the spring 104 transmitted by way of the loading element 98 and high-pressure fuel is supplied through the bore 66, past the valve body 78 and the outside of the cup-shaped loading element 98, into the fuel delivery opening 70, and to the high-pressure connection.

The foregoing relates to a preferred exemplary embodiment of the invention, it being understood that other variants and embodiments thereof are possible within the spirit and scope of the invention, the latter being defined by the appended claims.

What is claimed is:

1. A radial piston pump for high-pressure fuel delivery in fuel injection systems of internal combustion engines in a common rail injection system, comprising a drive shaft (4) that is supported in a pump housing (2), said drive shaft is eccentrically embodied or has a number of cam-like projections in the circumference direction, a number of pistons (12) which are arranged radially in relation to the drive shaft (4), each in a respective cylinder chamber (18), each of said pistons move in a reciprocating fashion in the cylinder chamber (18) when the drive shaft (4) rotates, a spring-preloaded check valve (42, 68) respectively on an intake side and on a high pressure side, a housing component (16) includes a through opening (20) that constitutes the cylinder chamber (18), a high-pressure delivery opening (66) leads away from the cylinder chamber (18) and in a sealing seat (76) of the high pressure side check valve (68), opens out into a mounting opening (74) in the component (16), said mounting opening contains the valve components (68), with the exception of a valve body (78) which is placed against the sealing seat (76), the high-pressure side check valve (68) is inserted into the mounting opening (74) as a preassembled unit (88) and is tightened against the component (16) to form a high-pressure seal, and that the valve unit (88) includes a cup-shaped loading element (98), which is pre-stressed in a closing direction and moves in a limited fashion in the closing or opening direction, and which, with an outside of a cup bottom (100), the loading element forces the valve body (78) into contact with the sealing seat (76).

2. The radial piston pump according to claim 1, in which the preassembled valve unit (88) has a sealing element (90) with an external thread (92), which is screw threaded into an internal thread (86) of the mounting opening (74).

3. The radial piston pump according to claim 2, in which the sealing element (90) rests with an axial shoulder or end face (94) against an axial step (82) of the mounting opening (74) and produces the high pressure seal in this manner.

4. The radial piston pump according to claim 3, in which the sealing surface pair of the sealing element (90) and the axial step (82) in the mounting opening (74) has a flat sealing surface on the one part and a sharp-edged, closed, circumferential projection (122) on another component, which when the components are tightened against each other, produce a high pressure seal.

5. The radial piston pump according to claim 1, in which the valve body (76) is ball-shaped and an outside of the cup bottom (100) has an arc shape that corresponds to the ball shape.

6. The radial piston pump according to claim 2, in which the valve body (76) is ball-shaped and an outside of the cup bottom (100) has an arc shape that corresponds to the ball shape.

7. The radial piston pump according to claim 3, in which the valve body (76) is ball-shaped and an outside of the cup bottom (100) has an arc shape that corresponds to the ball shape.

8. The radial piston pump according to claim 4, in which the valve body (76) is ball-shaped and an outside of the cup bottom (100) has an arc shape that corresponds to the ball shape.

9. The radial piston pump according to claim 1, in which from the sealing element (90), a pin-shaped projection (96) engages in the loading element (98) from a side remote from the cup bottom (100).

10. The radial piston pump according to claim 2, in which from the sealing element (90), a pin-shaped projection (96) engages in the loading element (98) from a side remote from the cup bottom (100).

11. The radial piston pump according to claim 3, in which from the sealing element (90), a pin-shaped projection (96) engages in the loading element (98) from a side remote from the cup bottom (100).

12. The radial piston pump according to claim 4, in which f rom the sealing element (90), a pin-shaped projection (96) engages in the loading element (98) from a side remote from the cup bottom (100).

13. The radial piston pump according to claim 9, in which the pin-shaped projection (96) has a diametrically reduced axial section (110) and that the cup-shaped loading element (98) engages with a projection in this axial section.

14. The radial piston pump according to claim 13, which the projection is constituted by a crimping of an edge (108) of the cup-shaped loading element (98) oriented toward the sealing element (90).

15. The radial piston pump according to claim 14, in which only one or a number of partial sections (112) in the circumference direction of the edge are crimped.

16. The radial piston pump according to claim 14, in which an uncrimped edge section (116) of the cup-shaped loading element (98) is placed against an axial stop face (120) in order to embody a stroke limitation.

17. The radial piston pump according to claim 15, in which an uncrimped edge section (116) of the cup-shaped loading element (98) is placed against an axial stop face (120) in order to embody a stroke limitation.

18. The radial piston pump according to claim 16, in which the axial stop face (120) is embodied by an end face (94) of the sealing element (90).

19. The radial piston pump according to claim 17, in which the axial stop face (120) is embodied by an end face (94) of the sealing element (90).

20. The radial piston pump according to claim 5, in which on an inside of the cup-shaped loading element (98), a spring (104) is provided, which is supported on one end against the inside of the cup bottom (100) and is supported on another end against an end face of the pin-shaped projection (96).

* * * * *